US006860319B2

(12) United States Patent
Eisenhour

(10) Patent No.: US 6,860,319 B2
(45) Date of Patent: Mar. 1, 2005

(54) ACID ACTIVATED CLAY FOR USE IN FOUNDRY SAND

(75) Inventor: Don Eisenhour, Grayslake, IL (US)

(73) Assignee: American Colloid Company, Arlington Heights, IL (US)

( * ) Notice: Subject to any disclaimer, the term of this patent is extended or adjusted under 35 U.S.C. 154(b) by 70 days.

(21) Appl. No.: 10/454,054

(22) Filed: Jun. 4, 2003

(65) Prior Publication Data

US 2004/0244943 A1 Dec. 9, 2004

(51) Int. Cl.[7] ..... B22C 1/18

(52) U.S. Cl. ..... 164/528; 164/527; 106/38.2; 106/38.9

(58) Field of Search ..... 164/527, 528; 106/38.2, 38.9

(56) References Cited

U.S. PATENT DOCUMENTS 4,163,000 A * 7/1979 Kashima et al. ..... 524/446

* cited by examiner

*Primary Examiner*—Kuang Y. Lin
(74) *Attorney, Agent, or Firm*—Marshall, Gerstein & Borun LLP

(57) ABSTRACT

A foundry sand binder formed by reacting a smectite clay containing exchangeable calcium ions with an acid to enhance the ability of the clay to bind sand in forming a metal casting sand mold. The acid-treated clay is an excellent sand binder for metal casting molds and produces cast metal parts having improved surface finish with the elimination or substantial reduction in carbonaceous, e.g., coal, foundry sand additive, while reducing VOC emissions from the foundry.

35 Claims, No Drawings

ACID ACTIVATED CLAY FOR USE IN FOUNDRY SAND

FIELD OF THE INVENTION

The present invention is directed to an acid-reacted clay binder for use as foundry sand binders in the casting of metal. More particularly, the present invention is directed to a foundry sand binder formed by reacting a smectite clay containing exchangeable calcium ions with an acid to enhance the ability of the clay to bind sand in forming a metal casting sand mold. The acid-treated clay is an excellent sand binder for metal casting molds and produces cast metal parts having improved surface finish with the elimination or substantial reduction in carbonaceous, e.g., coal, foundry sand additive, while reducing VOC emissions from the foundry.

BACKGROUND AND PRIOR ART

Sand molds are one of two kinds: (1) "green" sand molds are smectite clay/water bonded sand mixtures rammed against a pattern to form a desired contour (a top half or cope and a bottom half or drag are booked together to form a complete mold cavity). The sand is a tough, pliable mixture which will hold its molded shape. Molten metal is poured into the mold cavity where it solidifies to form the resultant casting; and (2) "rigid" molds are sand mixtures which can be molded against a pattern and then hardened into a rigid condition. The method of hardening depends on the kind of binder used. Although smectite clay bonded molds can be hardened by air-drying or baking, usually rigid molds are bonded with organic resins which harden into much stronger and harder shapes. Binders are designed to be hardened by several methods. Some are baked; some are cured or hardened by chemical reaction with a reagent; and some are hardened by flushing with a reactive gas.

Green sand molding is the production of molded metal objects from tempered molding sand and is the most diversified molding process used to cast ferrous as well as non-ferrous metal castings. Green sand molding is favored by foundry personnel because it is economical and permits both quality and quantity production, particularly for smaller castings. Castings as large as three to four tons are made successfully in green sand molds; however, as molds become larger, more time is required for the making and assembling of mold parts, consequently, other types of molding are generally favored for the larger castings. The rapid collapsibility of green sand molds makes them much less resistant to the normal contraction of the castings while metal solidification takes place, thus minimizing problems of stresses and strains. Green sand is defined as a water tempered molding sand mixture with plasticity. A green sand mold used for casting iron and steel usually consists of silica sand, a clay binder, and/or an organic binding agent mulled together with temper water and a coal additive. Other useful foundry sands including chromite, zircon and olivine sands.

Cores are sand shapes which are positioned inside the mold to shape the inside of a casting. If a core were not used, the casting would be solid metal and many castings are not solid, but have inside channels or configurations. Cores are usually rigid shapes employing the same kinds of binders and methods described above for rigid molds.

Much as pavement buckles on a hot day, a sand mold or core can buckle due to expansion during the casting operation. The high temperature expansion buckle of the mold wall causes a defect on the casting surface known as a "buckle" or a "scab". If a core expands too much, the core will crack or craze and metal will enter the crack to form an irregular fin of metal on the cored surface of the casting which must be removed. Obviously, less thermal expansion in a sand is a great advantage. U.S. Pat. Nos. 2,830,342 and 2,830,913 are directed to the excellent thermal stability of carbon sands. These sands are useful together with the additives and binders disclosed herein.

Relatively inexpensive silica sand grains bound together with a suitable binder are used extensively as a mold and core material for receiving molten metal in the casting of metal parts. Olivine sand is much more expensive than silica sand but, having better thermal stability than silica sand, provides cast metal parts of higher quality, particularly having a more defect-free surface finish, requiring less manpower after casting to provide a consumer-acceptable surface finish. Olivine sand, therefore, has been used extensively as a mold and core surface in casting non-ferrous parts in particular and has replaced silica sand in many of the non-ferrous foundries in the United States. Olivine sand, silica sand and combinations thereof also are useful together with the additives disclosed herein.

Spherical or ovoid grain, carbon or coke particles, known to the trade as petroleum fluid coke, also have been used as foundry sands where silica sands and olivine sands do not have the physical properties entirely satisfactory for casting metals such as aluminum, copper, bronze, brass, iron and other metals and alloys. Such a fluid coke carbon sand presently is being sold by AMCOL International Corporation of Arlington Heights, Ill. under the trademark CAST-RITE® and has been demonstrated to be superior to silica sand and olivine sand for foundry use. Each of these spherical or ovoid grain fluid coke carbon sand also are useful, alone or in combination with other types of foundry sands, together with the foundry sand additives disclosed herein.

Roasted carbon sand as described in U.S. Pat. No. 5,094,289, hereby incorporated by reference, is a low cost carbon sand designed primarily for low melting temperature metals, such as aluminum and magnesium. Roasting at 1300°–1400° F., will remove all of the volatile matter which would otherwise be evolved if raw fluid coke were exposed to aluminum poured at 1400° F. Other roasted carbons sands, having the porosity eliminated, are described in this Assignee's U.S. Pat. No. 5,215,143, hereby incorporated by reference. These roasted carbon sands also are useful, alone or in combination with other types of foundry sands, together with the additives disclosed herein.

All of the above-described foundry sands, and mixtures thereof, are suitable for admixture with the acid-treated clay binders of the present invention to form a foundry sand composition suitable to form a shaped mold for receiving molten metal in the manufacturing of shaped metal parts.

One or more binders mixed with the sand are essential to maintain the sand in a predetermined mold configuration. One of the most commonly employed green sand binders is clay, such as a water-swellable sodium bentonite clay or a low swellable calcium bentonite clay. The amount of the clay binder that is used together with the sand generally depends upon the particular type of sand used in the mixture and the temperature of pouring. Silica sand grains expand upon heating. When the grains are too close, the molding sand moves and expands causing the castings to show defects such as "buckles" (a deformity in the casting resulting from excessive sand expansion), "rat tails" (a rough, irregular depression that appears on the surface of a casting or a minor buckle), and "scabs" (a breaking away of a portion of the molding sand when hot metal enters the mold). To overcome this harmful expansion, more clay is added to the sand mixture since the clay contracts upon heating, thereby compensating for the expansion of the silica sand grains. In green sand molding, the reproducibility of the dimensions obtained on the casting are the result of such factors as shrinkage, changes in dimensions of mold cavity, hardness of mold, stability of molding sand, mechanical alignments of flask and maintaining a fixed temperature.

SUMMARY OF THE INVENTION

In brief, the present invention is directed to a foundry sand binder and method of manufacturing cast metal objects by casting molten metal into a mold cavity formed of sand held in a predetermined mold configuration by a binder comprising acid-reacted smectite clay. It has been found that acid-treated smectite clays unexpectedly improve the foundry sand used as a mold cavity for casting metal objects by unexpectedly improving the surface finish of cast metal parts with a reduced amount of carbonaceous, e.g., coal, foundry sand additives in the foundry sand composition. The acid reacts (ion-exchanges) with at least a portion of the calcium contained in the clay and the ion-exchanged calcium forms a water-insoluble calcium-containing precipitate. The calcium-containing precipitate should have a water-insolubility such that mixing 2 grams of the solid precipitate in 100 ml. of water at 25° C. results in at least a portion of the solid precipitate remaining.

Accordingly, one aspect of the present invention is to provide a new and improved foundry sand binder comprising one or more acid-treated smectite clays.

Another aspect of the present invention is to provide a new and improved foundry sand composition for use in forming a foundry mold comprising a blend of sand with an acid-treated smectite clay, wherein the foundry sand composition provides improved metal casting surface finish with a reduced or eliminated quantity of carbonaceous, e.g., coal, additives. The amount of acid used to treat the clay should be in the range of about 30 to about 160 meq. (milliequivalents) of hydrogen ion ($H^+$) per 100 grams of clay, preferably about 40 meq. to about 80 meq. per 100 grams of clay. More preferably, the amount of acid mixed with the clay should provide $H^+$ ions in an amount of about 20% to about 80% of the ion-exchange capacity of the clay; most preferably about 50–70% of the ion-exchange capacity of the clay.

Another aspect is to provide a new and improved foundry sand binder, foundry sand and method of molding cast metal objects by pouring molten metal against a foundry sand composition containing the new and improved acid-treated clay foundry sand binder that provides reduced VOC, e.g., benzene, emissions.

Still another aspect of the compositions and methods described herein is to provide a foundry sand binder, foundry sand compositions containing the binder, and methods of casting molten metal, that provides better metal part surface finish and less emission of VOCs than other foundry sands. The foundry sands containing an acid-treated clay binder provides cast metal parts with excellent surface finish, without, or with less, carbonaceous, e.g., coal, additives, and less gaseous organic compounds are liberated from the foundry sand, such as benzene, that are volatilized during the metal casting process.

Another aspect of the present invention is to provide a foundry sand binder; foundry sand composition, and methods of casting molten metal against a shaped foundry sand mold composition containing the acid-treated clay binder, wherein the foundry sand binder includes an acid-treated clay, such as calcium bentonite clay, in an amount of about 1% to about 15% by weight, based on the dry weight of the foundry sand composition.

The above and other aspects and advantages of the present invention will become more apparent from the following detailed description of the preferred embodiments of the invention taken in conjunction with the drawings.

DETAILED DESCRIPTION OF THE PREFERRED EMBODIMENT

Throughout this specification ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

A green sand mold used for casting iron and steel usually consists of silica sand, a clay binder, and/or an organic binding agent mulled together with temper water. Other useful foundry sands include chromite, zircon, fluid coke or carbon and olivine sands.

One or more binders mixed with the foundry sand is essential to maintain the sand in a predetermined mold configuration. One of the most commonly employed green sand binders is clay, such as a water-swellable sodium bentonite clay or a low swelling calcium bentonite clay. The amount of the clay binder that is used together with the sand generally depends upon the particular type of sand used in the mixture and the temperature of firing. Silica sand grains expand upon heating. When the grains are too close, the molding sand moves and expands causing the castings to show defects such as "buckles" (a deformity in the casting resulting from excessive sand expansion), "rat tails" (a rough, irregular depression that appears on the surface of a casting or a minor buckle), and "scabs" (a breaking away of a portion of the molding sand when hot metal enters the mold). To overcome this harmful expansion, more clay is added to the sand mixture since the clay contracts upon firing thereby compensating for the expansion of the silica sand grains.

Any binder ordinarily used to bind silica, olivine, chromite, carbon, and/or zircon foundry sands can be used with the foundry sand binders disclosed herein to enable the sand to retain a predetermined or desired shape as a mold or core material. Such binders generally are present in amounts of about 1% to about 15% based on the total dry weight of the foundry sand mixture and may be adjusted to whatever amounts that will produce the desired strength, hardness or other desirable physical properties. Some of the binders which can be used in the foundry sand of this invention include bentonites, other clays, starches, sugars, cereals, core oils, sodium silicates, thermoplastic and thermosetting resins, vapor-curing binders, chemically-curing binders, heat-curing binders, pitches, resins, cements and various others known in the art.

Common additives for the foundry sand compositions described herein include cellulose, cereal, or other fibrous additives included for the purpose of overcoming sand expansion defects, particularly those defects occurring on flat casting surfaces, in an amount of about 0.5 to about 5% by weight of the dry sand composition. Typical cellulose additives include wood flour and cereals such as dry flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements, e.g., Portland; natural cements, such as heated, ground limestone, resins and the like in amounts of about 3% to about 6% by weight of the dry sand also can be added to foundry sand binders of the present invention.

Various other additives may be included in the foundry sand compositions described herein, such as various blackings or other carbonaceous materials, such as graphite; pitch; charcoal; bituminous coal, or soft coal, such as seacoal; hard coal; and coke which can be used with, or as a partial clay substitute for wet coating to prevent metal penetration or burn-on; chemical agents, such as resin binders; china clay; oils, such as linseed oil and the like. These additional additives generally are included in amounts of less than about 1.0% by weight of the sand and, generally, in an amount of 0 to about 10% by dry weight total.

Sodium smectite clays, e.g., sodium bentonite or sodium montmorillonite clays, are known to supply the required dry and hot strengths to prevent cutting, washing and eroding of the molds when molten metal passes over them. Sodium bentonite is more durable than calcium bentonite, and requires less replacements in reused molding sand mixtures. Further sodium bentonite bonded molding sands have a gummier feel than calcium bentonite bonded sand mixtures when the temper water is added and mulled into the sand mixtures. Sodium bentonite sand mixtures are said to be "tougher" and not as "brittle" as calcium bentonite bonded molding sands prepared in the same manner. It is also known to treat calcium bentonite with a sodium carbonate treatment, a process known as peptizing, to convert the calcium bentonite to a swelling sodium bentonite. Generally, the clay or clay mixture is used in the sand, e.g., silica sand, generally about 3% to about 10% by weight based on the dry weight of the total sand content. It is understood in the foundry industry that by adding more clay binder to a foundry sand mixture, more water is also required. Therefore, it is often the case that by using less clay binder in a foundry sand mixture and reducing the amount of temper water added, the foundry sand mixture is just as strong as it would be with a higher percentage of clay binder and water.

In one embodiment, the clay has a moisture content in the range of about 20% by weight to about 50% by weight, preferably about 25% by weight to about 40% by weight, more preferably about 30% by weight to about 35% by weight, based on the weight of the clay after mixing the acid with the clay and sand.

In accordance with an important feature of the present invention, it has been found that unexpected improvements in the foundry sand are achieved by acid-treating one or more calcium bentonite or calcium montmorillonite clays. It should be understood, however, that the clay used to bind the foundry sand can include smectite clays having a predominant metal ion other than calcium, e.g., sodium, so long the clay has at least 10% exchangeable calcium, preferably at least 25%.

EXAMPLES

The following examples serve to illustrate the main features of the invention. Green sands were prepared by using the compositions described in examples 1 through 7. Mixtures were mulled until consistent properties were maintained, and moisture levels were adjusted to achieve a compactability of between 40 and 42, in accordance with American Foundry Society (AFS) Method # AFS 2220-00-S. Step cast molds were poured using gray iron having the following properties: carbon equivalence 3.60 to 4.20 wt. %; carbon 3.00 to 3.50 wt. %; silicon 1.80 to 2.20 wt. %; sulfur 0.05 to 0.12 wt. %; manganese 0.15 to 0.40 wt. %; and phosphorous 0.06 to 0.11 wt. %.

Data collected in all examples were obtained in accordance with the American Foundry Society (AFS) Methods as follows: Compactability: AFS 2220-00-S; Dry Compressive Strength (DCS): AFS 2220-00-S; Green Compressive Strength (GCS): AFS 5202-00-S; Hot Compressive Strength (HCS): AFS 5234-00-S; and Wet Tensile Strength (WTS): AFS 2206-00-S. All of these procedures are detailed in the American Foundry Society, Mold & Core Test Handbook. Third Ed. 2001. The calcium bentonite clay was the same in every example and had a cation exchange capacity of 102 meq. per 100 grams of clay.

Example #1 shows typical properties of a green sand molding composition containing 2.40% by wt. seacoal and 8.00% by wt. calcium bentonite. The surface of the casting produced with this green sand was graded as good on a scale of very good, good, moderate, poor, and very poor. Benzene emissions for this green sand were 372 $\mu$g/g. Example #2 shows results from the same molding sand without seacoal. Benzene emissions dropped to 27 $\mu$g/g but the casting surface was poor due to the excessive amount of silica sand adhering to the casting.

In example #3, the composition was kept the same as in example #2 but with the addition of 0.08% sulfuric acid (100% active). This quantity of acid contributes an amount of protons equal to about 20% of the cation exchange capacity of the calcium bentonite clay. The benzene emissions remained low due to the absence of seacoal and the casting surface improved moderately. In example #4, the composition was kept the same as in example #2 with the exception of the addition of 0.31% sulfuric acid (100% active). This quantity of acid contributes an amount of protons equal to about 80% of the cation exchange capacity of the calcium bentonite clay. Benzene emissions remained low and the casting surface improved to good, comparable to example #1 where 2.40% seacoal was used.

Examples #5, 6 and 7 show results for citric acid, oxalic acid, and dl-tartaric acid, respectively. In each case, a quantity of acid was added to supply an amount of protons equal to about 80% of the cation exchange capacity of the calcium bentonite clay. Other suitable acids that, when ion-exchanged with a calcium-containing smectite clay, form a water-insoluble precipitate (if mixing 2 grams of the solid precipitate in 100 ml. of water at 25° C. results in at least a portion of the solid precipitate remaining) include hydrochloric acid, phosphoric acid, succinic acid, maleic acid, malonic acid and o-phthalic acid.

Example #1

| Component | wt. % |
|---|---|
| Ca Bentonite | 8.00 |
| Seacoal | 2.40 |
| Water | 2.85 |
| $H_2SO_4$ | 0.00 |
| Sand | 86.75 |
| pH | 7.98 |

-continued

| Component | wt. % |
|---|---|
| GCS (psi) | 26 |
| DCS (psi) | 85 |
| WTS (N/cm$^2$) | 0.270 |
| HCS @ 1650° F. (psi) | 325 |
| HCS @ 1850° F. (psi) | 168 |
| HCS @ 2000° F. (psi) | 73 |
| Benzene emissions (μg/g) | 372 |
| Casting Surface Quality | good |

Example #2

| Component | wt. % |
|---|---|
| Ca Bentonite | 8.00 |
| Seacoal | 0.00 |
| Water | 2.77 |
| $H_2SO_4$ | 0.00 |
| Sand | 89.23 |
| pH | 7.63 |
| GCS (psi) | 27 |
| DCS (psi) | 69 |
| WTS (N/cm$^2$) | 0.216 |
| HCS @ 1650° F. (psi) | 185 |
| HCS @ 1850° F. (psi) | 132 |
| HCS @ 2000° F. (psi) | 105 |
| Benzene emissions (μg/g) | 27 |
| Casting Surface Quality | poor |

Example #3

| Component | wt. % |
|---|---|
| Ca Bentonite | 8.00 |
| Seacoal | 0.00 |
| Water | 2.74 |
| $H_2SO_4$ | 0.08 |
| Sand | 89.18 |
| pH | 5.44 |
| GCS (psi) | 25 |
| DCS (psi) | 77 |
| WTS (N/cm$^2$) | 0.239 |
| HCS @ 1650° F. (psi) | 227 |
| HCS @ 1850° F. (psi) | 127 |
| HCS @ 2000° F. (psi) | 95 |
| Benzene emissions (μg/g) | 24 |
| Casting Surface Quality | moderate |

Example #4

| Component | wt. % |
|---|---|
| Ca Bentonite | 8.00 |
| Seacoal | 0.00 |
| Water | 2.78 |
| $H_2SO_4$ | 0.31 |
| Sand | 88.91 |
| pH | 3.81 |
| GCS (psi) | 26 |
| DCS (psi) | 65 |
| WTS (N/cm$^2$) | 0.222 |

-continued

| Component | wt. % |
|---|---|
| HCS @ 1650° F. (psi) | 187 |
| HCS @ 1850° F. (psi) | 132 |
| HCS @ 2000° F. (psi) | 95 |
| Benzene emissions (μg/g) | 22 |
| Casting Surface Quality | good |

Example #5

| Component | wt. % |
|---|---|
| Ca Bentonite | 8.00 |
| Seacoal | 0.00 |
| Water | 2.70 |
| Citric Acid | 0.41 |
| Sand | 88.89 |
| pH | 4.05 |
| GCS (psi) | 23 |
| DCS (psi) | 57 |
| WTS (N/cm$^2$) | 0.284 |
| HCS @ 1650° F. (psi) | 335 |
| HCS @ 1850° F. (psi) | 128 |
| HCS @ 2000° F. (psi) | 163 |
| Benzene emissions (μg/g) | 34 |
| Casting Surface Quality | v. good |

Example #6

| Component | wt. % |
|---|---|
| Ca Bentonite | 8.00 |
| Seacoal | 0.00 |
| Water | 2.72 |
| Oxalic Acid | 0.29 |
| Sand | 88.99 |
| pH | 3.97 |
| GCS (psi) | 25 |
| DCS (psi) | 48 |
| WTS (N/cm$^2$) | 0.230 |
| HCS @ 1650° F. (psi) | 132 |
| HCS @ 1850° F. (psi) | 102 |
| HCS @ 2000° F. (psi) | 75 |
| Benzene emissions (μg/g) | 32 |
| Casting Surface Quality | good |

Example #7

| Component | wt. % |
|---|---|
| Ca Bentonite | 8.00 |
| Seacoal | 0.00 |
| Water | 2.75 |
| dl-tartaric | 0.48 |
| Sand | 88.77 |
| pH | 4.12 |
| GCS (psi) | 27 |
| DCS (psi) | 36 |
| WTS (N/cm$^2$) | 0.206 |
| HCS @ 1650° F. (psi) | 145 |
| HCS @ 1850° F. (psi) | 103 |
| HCS @ 2000° F. (psi) | 82 |
| Benzene emissions (μg/g) | 41 |
| Casting Surface Quality | good |

What is claimed is:

1. A foundry sand comprising one or more sands containing a smectite clay binder in an amount sufficient to bind the sand together such that the foundry sand has sufficient strength such that a surface of the foundry sand can be formed into a shape and said shaped surface receives molten metal on the formed surface resulting in a solidified metal part having a surface corresponding in shape to the formed foundry sand surface, wherein the clay binder comprises a smectite clay containing calcium that is treated with an acid that reacts with at least a portion of the calcium contained in the clay to form a water-insoluble precipitate.

2. A foundry sand in accordance with claim 1, wherein the clay is reacted with about 30 to about 160 meq. of $H^+$ per 100 grams of clay.

3. A foundry sand in accordance with claim 1, wherein the clay is reacted with about 40 to about 80 meq. of $H^+$ per 100 grams of clay.

4. A foundry sand in accordance with claim 1, wherein the acid is selected from the group consisting of sulfuric acid, oxalic acid, citric acid, or mixtures thereof.

5. A foundry sand in accordance with claim 1, wherein the clay is reacted with about 30 meq. to about 160 meq. of $H^+$ per 100 grams of clay.

6. A foundry sand in accordance with claim 1, wherein the clay is reacted with about 40 meq. to about 80 meq. per 100 grams of clay.

7. A foundry sand in accordance with claim 5, wherein the clay has a cation exchange capacity of 30 to 160 meq. per 100 grams of clay.

8. A foundry sand in accordance with claim 7, wherein the clay has a cation exchange capacity of 70 to 130 meq. per 100 grams of clay.

9. A foundry sand in accordance with claim 1, wherein the clay and sand combination has a moisture content in the range of about 2.70% by weight to about 2.85% by weight after mixing the acid with the clay and sand.

10. A foundry sand in accordance with claim 1, wherein the foundry sand has a carbonaceous material additive in an amount of about 0 to about 4% by weight, based on the total weight of the foundry sand.

11. A foundry sand in accordance with claim 10, wherein the foundry sand has a carbonaceous material additive in an amount of about 0.5 to about 3% by weight, based on the total weight of the foundry sand.

12. A foundry sand in accordance with claim 11, wherein the foundry sand has a carbonaceous material additive in an amount of about 0.1 to about 2% by weight, based on the total weight of the foundry sand.

13. A method of manufacturing a foundry sand composition comprising adding to one or more sands a smectite clay containing calcium, and contacting the clay with an acid that reacts with calcium in the clay to produce a water-insoluble calcium-containing precipitate to form a foundry sand binder comprising the acid-reacted clay.

14. A method in accordance with claim 13, wherein the clay is reacted with the acid prior to adding the acid-reacted clay to the sand.

15. A method in accordance with claim 13, wherein the clay and the sand are combined prior to reacting the clay with the acid, and the acid is added to the clay and sand combination including the step of mixing the clay and sand for better contact of the acid with the clay.

16. A method in accordance with claim 13, wherein the clay is reacted with about 30 meq. to about 160 meq. of $H^+$ per 100 grams of clay.

17. A method in accordance with claim 16, wherein the clay is reacted with about 70 meq. to about 130 meq. of $H^+$ per 100 grams of clay.

18. A method in accordance with claim 13, wherein the clay is reacted with about 40 meq. to about 80 meq. of $H^+$ per 100 grams of clay.

19. A method in accordance with claim 16, wherein the clay has a cation exchange capacity of 30 to 160 meq. per 100 grams of clay.

20. A method in accordance with claim 15, wherein the clay has a moisture content in the range of about 20% by weight to about 50% by weight based on the weight of the clay after mixing the acid with the clay and sand.

21. A method in accordance with claim 20, wherein the clay has a moisture content in the range of about 25% by weight to about 40% by weight based on the weight of the clay after mixing the acid with the clay and sand.

22. A method in accordance with claim 21, wherein the clay has a moisture content in the range of about 30% by weight to about 35% by weight based on the weight of the clay after mixing the acid with the clay and sand.

23. The method of claim 20, wherein the acid is solid or liquid when added to the clay.

24. The method of claim 23, wherein the acid is sulfuric acid, oxalic acid, citric acid, or an acid that forms a calcium precipitate by reaction with calcium released from the clay upon ion-exchange with the acid, said precipitate having a solubility in water such that when 2 grams of the precipitate is mixed in 100 ml. of water at 25° C., not all of the precipitate is solubilized.

25. A method in accordance with claim 13, wherein the foundry sand has a carbonaceous material additive in an amount of about 0 to about 4% by weight, based on the total weight of the foundry sand.

26. A method of improving the surface finish of a cast metal part produced by casting molten metal into a shaped mold comprising one or more sands and a binder formed into the shaped mold, wherein the binder comprises a smectite clay containing calcium that is treated with an acid that reacts with at least a portion of the calcium contained in the clay to form a water-insoluble calcium-containing precipitate.

27. A method in accordance with claim 26, wherein the clay is reacted with the acid prior to adding the acid-reacted clay to the sand.

28. A method in accordance with claim 26, wherein the clay and the sand are combined prior to reacting the clay with the acid, and the acid is added to the clay and sand combination including the step of mixing the clay and sand for better contact of the acid with the clay.

29. A method in accordance with claim 26, wherein the clay is reacted with about 30 meq. to about 160 meq. of $H^+$ per 100 grams of clay.

30. A method in accordance with claim 26, wherein the clay is reacted with about 40 meq. to about 80 meq. of $H^+$ per 100 grams of clay.

31. A method in accordance with claim 29, wherein the clay has a cation exchange capacity of 30 to 160 meq. per 100 grams of clay.

32. A method in accordance with claim 28, wherein the clay has a moisture content in the range of about 20% by weight to about 50% by weight after mixing the acid with the clay and sand.

33. The method of claim 32, wherein the acid is solid or liquid when added to the clay.

34. The method of claim 33, wherein the acid is selected from the group consisting of sulfuric acid, hydrochloric acid, phosphoric acid, oxalic acid, succinic acid, maleic acid, malonic acid, o-phthalic acid, citric acid, and a mixture thereof.

35. A method in accordance with claim 26, wherein the foundry sand has a carbonaceous material additive in an amount of about 0 to about 4% by weight, based on the total weight of the foundry sand.

* * * * *